US005235840A

United States Patent [19]

Blazevic

[11] Patent Number: 5,235,840

[45] Date of Patent: Aug. 17, 1993

[54] PROCESS TO CONTROL SCALE GROWTH AND MINIMIZE ROLL WEAR

[75] Inventor: David T. Blazevic, Olympia Fields, Ill.

[73] Assignee: Hot Rolling Consultants, Ltd., Homewood, Ill.

[21] Appl. No.: 811,961

[22] Filed: Dec. 23, 1991

[51] Int. Cl.[5] ..... B21B 27/06

[52] U.S. Cl. ..... 72/201; 72/13; 72/364; 72/39

[58] Field of Search ..... 72/201, 200, 202, 13, 72/10, 8, 39, 40, 364

[56] References Cited

U.S. PATENT DOCUMENTS

| | | | |
|---|---|---|---|
| 3,514,984 | 6/1970 | Cook | 72/201 |
| 3,604,234 | 9/1971 | Hinrichsen | 72/201 |
| 3,656,330 | 4/1972 | Brown et al. | 72/201 |
| 3,766,763 | 10/1973 | Cofer et al. | 72/201 |
| 3,779,054 | 12/1973 | Greenberger | 72/201 |
| 3,881,337 | 5/1975 | Cofer et al. | 72/201 |
| 3,905,216 | 9/1975 | Hinrichsen | 72/201 |
| 4,043,166 | 8/1977 | Leroy | 72/201 |
| 4,247,047 | 1/1981 | Schaming | 72/201 |
| 4,274,273 | 6/1981 | Fapiano et al. | 72/201 |
| 4,796,450 | 1/1989 | Blazevic | 72/201 |
| 4,899,547 | 2/1990 | Irwin | 72/13 |

FOREIGN PATENT DOCUMENTS

| | | | |
|---|---|---|---|
| 0068522 | 6/1981 | Japan | 72/39 |
| 0156824 | 9/1982 | Japan | 72/13 |

*Primary Examiner*—Lowell A. Larson
*Assistant Examiner*—Michael J. McKeon
*Attorney, Agent, or Firm*—Leydig, Voit & Mayer

[57] ABSTRACT

A system for processing steel strips in a hot strip mill includes an apparatus and method for minimizing oxide growth on steel strips and reducing wear on work rolls in the finishing mill. In order to reduce oxide build up, steel strips are sprayed with coolant at selected locations throughout the finishing mill and the surface temperature of the strips is controlled to be within the range of an upper limit ($T_u$) and a lower limit ($T_L$) where oxide growth is minimized. Accordingly, wear on the work rolls due to abrasive contact with the steel strips is reduced.

5 Claims, 7 Drawing Sheets

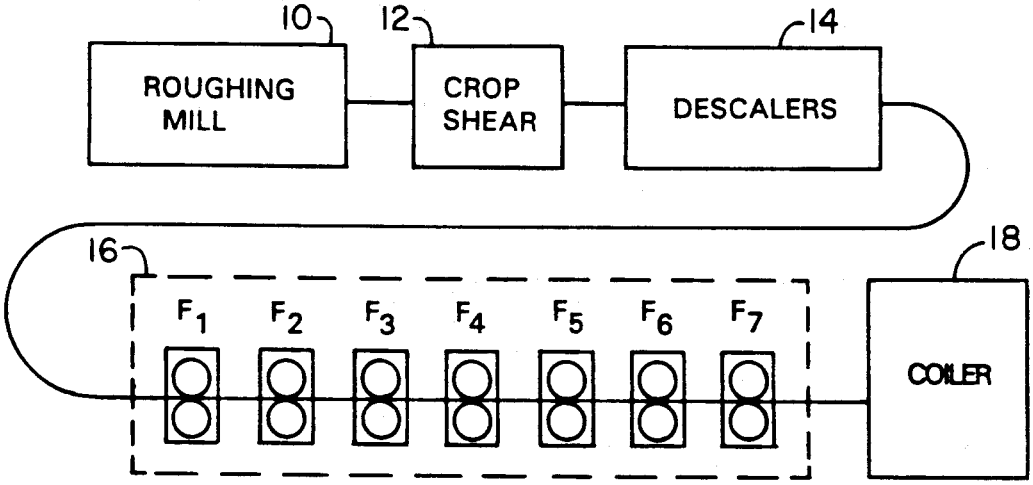
FIG. 1 (PRIOR ART)
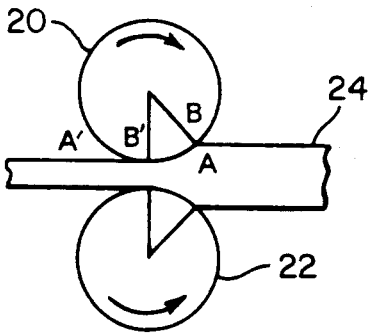
FIG. 2
FIG. 3
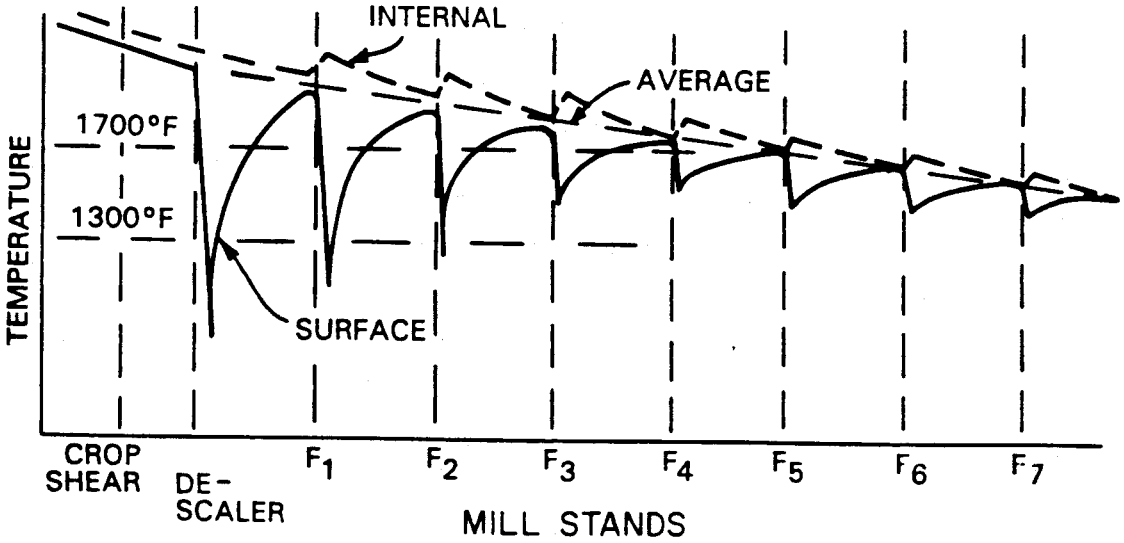

PROCESS TO CONTROL SCALE GROWTH AND MINIMIZE ROLL WEAR

TECHNICAL FIELD

This invention generally relates to hot strip mill processing of steel strips. More particularly, it is directed to an apparatus and method for reducing the rate of wear of work rolls in the mill and reducing the growth of abrasive oxide layers on the strips.

BACKGROUND OF THE INVENTION

In a hot strip mill, relatively wide steel slabs are rolled into very thin strips. Typically, hot strip mills operate in three stages: 1) the roughing stage, 2) the finishing stage, and 3) the coiling stage. In the roughing stage the slab is directed to a roughing mill where thickness reduction takes place. For example, it is typical for a slab having a thickness of between 8 and 10 inches to be reduced to a thickness of 1¼ inches. In the finishing stage the reduced slab, hereinafter referred to as a strip, is directed to a finishing mill where it is reduced to a strip approximately 0.500–0.050 inches thick. From the finishing mill, the strips are coiled for convenience of handling and further processing. Traditionally, finishing mills consist of approximately four to seven closely spaced stands.

Heretofore, hot strip mills have been plagued by rapid and excessive wear of the work rolls. This condition is triggered when abrasive iron oxide layers form on steel strips and the strips are pressed by the work rolls. When the strips contact the work rolls, the iron oxide grinds against the work roll surface thus causing the rolls to become excessively worn and to deteriorate prematurely. In addition, the growth of the oxide can be so great as to fracture during rolling creating surface defects called "heat pattern", "salt and pepper" and "roll wear" scale—three common varieties of rolled in scale. These defects combined with the total oxide thickness affect the removal of the oxides by acid pickling on subsequent processing units. (There are several different types of iron oxide layers that form on steel strips. When discussed collectively hereinbelow, they will be referred to as iron oxide).

Iron oxide formation is a function of temperature and time. That is, the longer the strip is exposed to high temperatures, the higher the rate and volume of iron oxide formation. The temperature in a typical finishing mill ranges between 1500° F. and 1900° F. In that temperature range, steel oxidizes rapidly; and, therefore, in a relatively short period of time substantial amounts of iron oxide are formed on the strip prior to its entrance into the finishing mill.

A known technique for removing iron oxide is to spray the strip with pressurized liquid. This technique is sometimes referred to as "descaling" and it is discussed in more detail in U.S. Pat. No. 3,766,763 issued to Cofer et al. and U.S. Pat. No. 4,043,166 issued to Leroy. While the descaling technique is successful in removing iron oxide from the strips, it does not address the fundamental problem of iron oxide formation. Hence, although iron oxide is removed from the strips during descaling, iron oxide is reformed on the strips as they pass through the mills and are exposed to high temperatures. Accordingly, the descaling technique will not adequately protect against wear and deterioration of the work rolls of a mill, nor can it reduce the total oxide formations that cause rolled in scale defects or influence the removal of oxide during subsequent processing.

SUMMARY OF THE INVENTION

In view of the foregoing, it is a general object of the present invention to reduce the rate of wear experienced by the work rolls in the finishing stage of a hot rolling mill.

Another object of the invention is to reduce oxide growth to minimize the rolled in scale defects created after descaling.

Yet another object of the invention is to reduce the total oxide thickness to enhance removal by subsequent acid pickling operations.

It is a more particular object of the invention to reduce the formation of oxides in a manner that allows the invention to be retrofitted into existing mills.

A more specific object of the invention is to control the growth of iron oxides on the surface of the strips by oxide-type and by volume in order to reduce the abrasion of the work rolls caused by the oxides.

A still more specific object of the invention is to reduce the buildup of various iron oxides that are formed on the surface of the strips in a finishing mill and in particular to reduce the buildup of the more abrasive oxides and, thereby, lessen the abrasive wearing on the work rolls caused by the oxides.

These and other objects are realized by a system for reducing oxide growth in a hot strip mill including interstand coolers located between individual stands of a finishing mill. The interstand coolers are coupled to a controller which controls the coolers to maintain the surface temperature of the strips between an upper limit ($T_U$) and a lower limit ($T_L$).

The method aspects of the invention are implemented by descaling the strips at a selected point which is a predetermined distance upstream from a first stand; spraying the strips with coolant at each of the interstand coolers; and controlling the spraying of coolant in order to maintain the surface temperature of the strip substantially at all times below the upper limit ($T_U$) as the strip is worked through the stands of the finishing mill.

Other objects and advantages of the invention will become apparent from reading the following detailed description.

BRIEF DESCRIPTION OF THE DRAWINGS

FIG. 1 is a block diagram of a conventional rolling mill that may be retrofitted to incorporate the invention.;

FIG. 2 is a schematic diagram of a pair of opposing work rolls in the rolling mill of FIG. 1, showing the deformation of a steel strip at the nip between the rolls, which inherently causes abrasive slippage between the strip and the surfaces of the rolls;

FIG. 3 is an exemplary graph of the internal, surface and average temperatures of one area of a strip as it passes through stands $F_1$ through $F_N$ of a finishing mill within the rolling mill;

Figure 4:
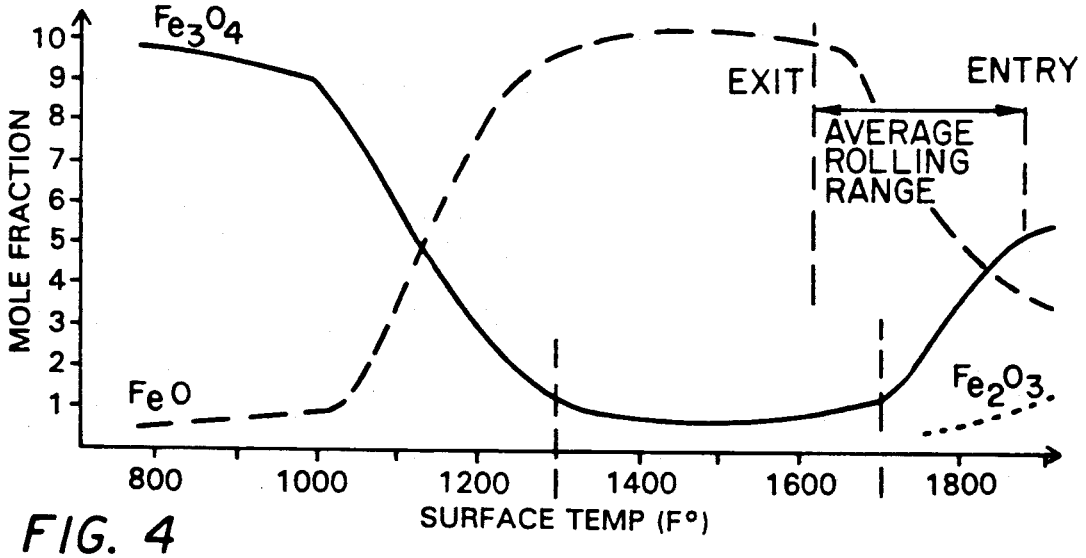
FIG. 4 is an exemplary graph illustrating the relative amounts of various iron oxides formed on the surface of strips over a range of temperatures typically experienced by the strips in the finishing mill.
Figure 5:
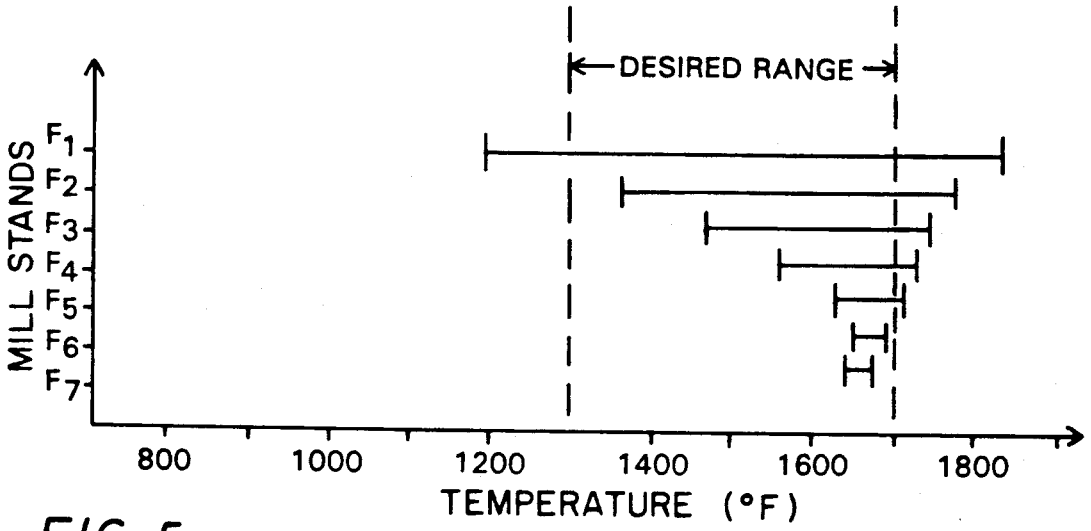
FIG. 5 is a graph illustrating typical ranges of temperatures experienced by a strip at each one of the stands $F_1$ through $F_N$, of the finishing mill in FIG. 1.

While the invention will be described in connection with a preferred embodiment, it will be understood that the following description is not intended to limit the invention to a particular embodiment. On the contrary, it is applicant's intention to cover all alternatives and equivalents as may be included within the spirit and scope of the invention.

DETAILED DESCRIPTION OF THE EMBODIMENTS

A typical hot strip mill is depicted in FIG. 1. For the purpose of explanation, the invention is described hereinbelow with reference to the hot strip mill illustrated in FIG. 1; however, the invention can be employed with any known hot strip mill arrangement. A steel strip is directed to roughing mill 10 where it is processed (rolled) so that its thickness is reduced. Upon exit from the roughing mill 10, the strip is cut by a crop shear 12 and routed through descalers 14 which propel a high velocity pressurized liquid onto the surface area of the strip in order to remove iron oxide build up. The strip then enters finishing mill 16 where it is processed so that its thickness is further reduced. As illustrated, finishing mill 16 includes seven stands F1–F7, each composed of a pair of cooperating work rolls. When the processing is finished the strip is directed to coiler 18 where it is wound into a coil for ease of transportation. While the finishing mill of FIG. 1 is depicted having seven stands, greater or fewer stands can be employed to accommodate the requirements of a given hot strip mill. Steel strips are deformed at a roughing mill 10 and a finishing mill 16 through the rolling process. Referring particularly to FIG. 2, in the rolling process, a steel strip 24 enters the bite of work rolls 20 and 22, and point A of the strip 24 makes contact with point B of the work rolls 20 and 22. As the work rolls 20 and 22 rotate and the strip 24 is reduced, point B moves to position B'. Likewise, point A moves to position A' and the strip is elongated and reduced. The percentage of reduction is proportional to the increase in length of the strip as defined by the following equation:

$$\% \text{ REDUCTION} = [1-(B-B')/(A-A')] \times 100$$

where (B—B') represents the radial distance traveled by the work rolls 20 and 22 over a given period of time, and (A—A') represents the distance traveled by the strip 24 over the same period of time.

During the rolling process, the work rolls 20 and 22 sometimes slide across the surface of the steel strip. Since the steel strip is covered with abrasive iron oxide, the sliding action causes the iron oxide to grind away part of the work rolls 20 and 22. Likewise, the work rolls 20 and 22 cause some iron oxide to peel away from the strip surface. In some cases pieces of the iron oxide are pushed by the roll on top of each other creating double layers of oxide which becomes a defect called "rolled in scale", or more specifically "heat pattern", "salt and pepper" and/or "roll wear" scale.

Referring now to FIG. 4, there are shown three different types of iron oxide layers. $Fe_2O_3$ is the top or outer layer and it is also the most abrasive oxide. $Fe_3O_4$ is the middle layer and the next most abrasive oxide, and FeO is the bottom layer and the least abrasive oxide. The thickness of each oxide layer is temperature dependent. For example, at 800° F. a very large mole fraction of $Fe_3O_4$ (between 9 and 10) is formed while a very small mole fraction of FeO (between 0 and 1) is formed. In contrast, at 1400° F. a very large mole fraction of FeO (between 9 and 10) is formed while a very small mole fraction of $Fe_3O_4$ (between 0 and 1) is formed. The most abrasive oxide layer, $Fe_2O_3$, does not begin to form in significant quantities until the temperature reaches approximately 1750° F.

The rolling process in a conventional finishing mill is implemented at temperatures ranging from 1600° F. to 1850° F. Although the temperature may fluctuate by approximately 50° F., typically a steel strip enters the finishing mill at 1850° F. and exits at 1600° F. Referring to FIG. 4, it is evident that at the conventional entry temperature of 1850° F. substantial amounts of the more abrasive oxides are formed. It is further evident that the temperature range in which the least amount of abrasive oxides are formed is between 1300° F. and 1700° F.

Figure 6:
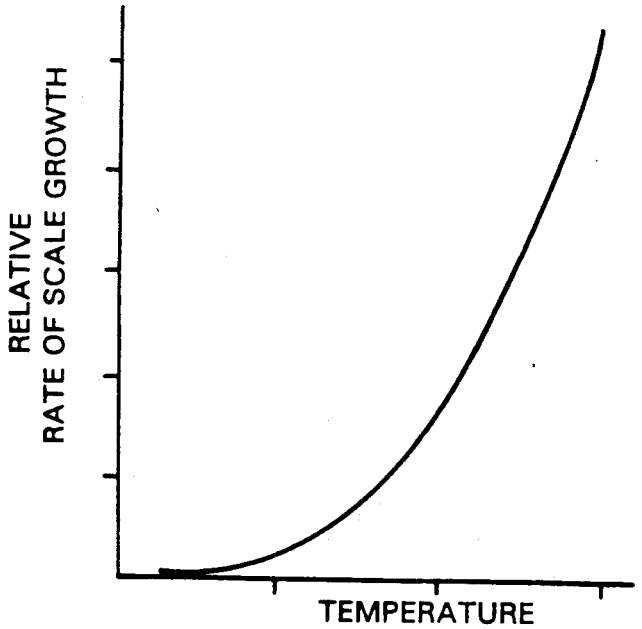
FIG. 6 is a graph illustrating the relationship between the surface temperature of a strip and the relative rates of total oxidation.

Another factor in oxide layer growth is time. Steel oxidizes in relation to an oxidizing rate factor "K" which changes with temperature. FIG. 6 illustrates that the K factor increases exponentially with temperature. Thus, if it becomes necessary to raise or lower the surface temperature of the strip outside of the desired range of 1300° F. to 1675° F. during the rolling process, the temperature should be lowered because the rate of oxide growth is significantly lower at lower temperatures.

It is noteworthy that a conventional finishing mill, such as that depicted in FIG. 1, inherently provides some temperature control. For instance, strips are cooled during the descaling operation. They are further cooled through conduction when they make contact with the work rolls. Lastly, strips are cooled due to radiation. FIG. 3 generally depicts the surface, internal and average temperature characteristics of the strip at the various stands of a finishing mill.

Figure 9:
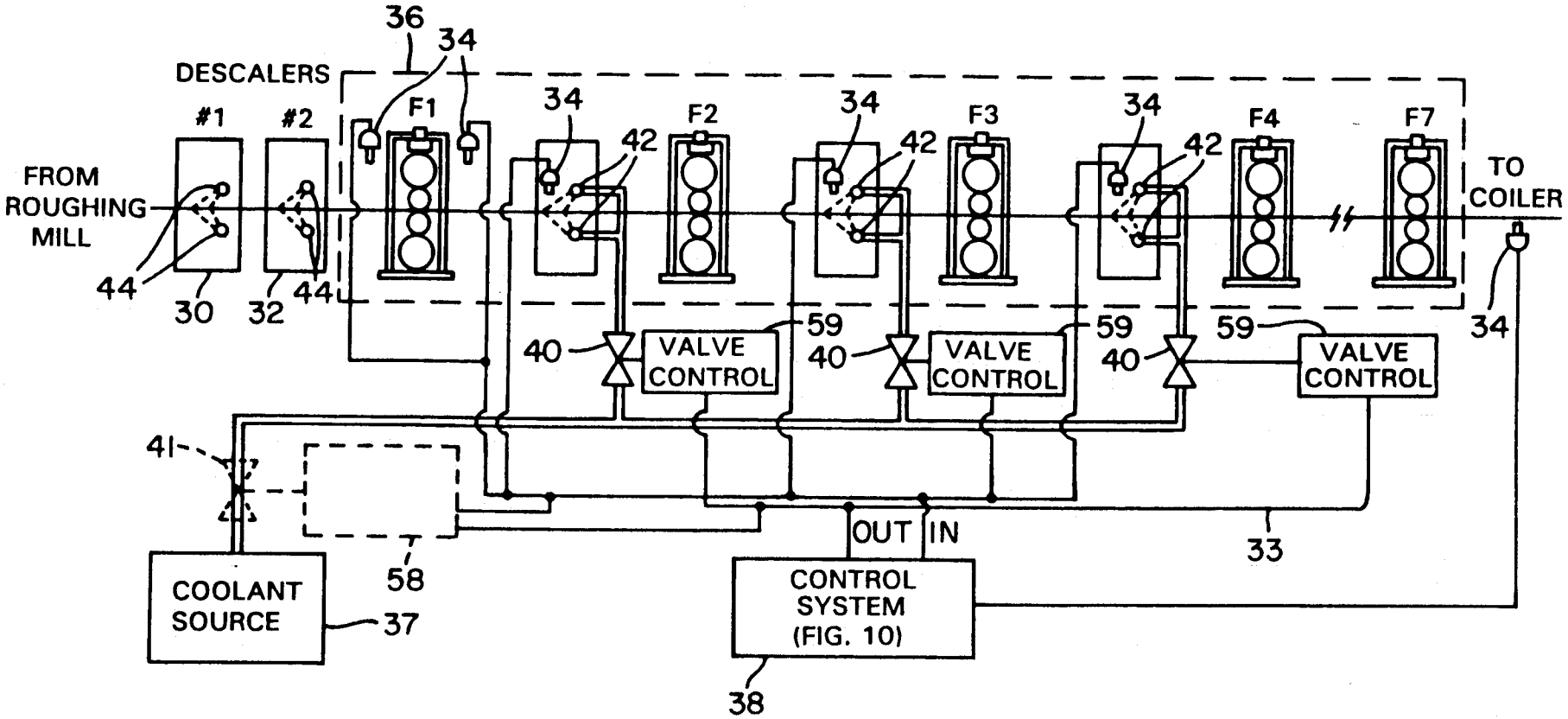
FIG. 9 is a block diagram of a finishing mill equipped with the sensor, control and cooling unit hardware necessary to implement the invention.

To augment the inherent cooling provided by a finishing mill, an automated temperature control system is provided for maintaining the temperature of the strip within a range which permits minimum growth of iron oxide and which reduces the rate of wear experienced by the work rolls. An exemplary temperature control system according to the instant invention is depicted in FIG. 9 and it includes descalers 30 and 32 positioned upstream from the finishing mill 36. The finishing mill 36 is composed of a number of finishing stands F1–F7. Each stand includes opposing work rolls supported in a frame and a screwdown for adjusting the position of the work rolls. A number of temperature detectors 34 are placed at upstream and downstream locations with respect to the finishing mill 36 as well as between the first four stands F1–F4.

To provide temperature control, the temperature detectors 34 and the valve controls 59 are connected to a microprocessor-based control system 38 via a bus line 33. Interstand spray headers 42 are connected to valve controls 59 and disposed between finishing stands to spray the strip with coolant at predetermined locations. The valve controls 59 open and close the control valves 40 responsive to control signals generated by the microprocessor-based control system 38. Coolant is supplied to control valves 40 through a conduit 35. The amount of coolant applied to the strip from coolant source 37 is controlled by microprocessor-based control system 38 via valve controls 59, control valves 40 and interstand spray headers 42. As a result of this arrangement, the strip temperature is maintained between 1300° F. and 1675° F.—the temperature range at which the least amount of growth of abrasive oxide layers, $Fe_2O_3$ and $Fe_3O_4$, occurs.

Referring more particularly to FIG. 9, as the strip exits the roughing mill (not shown) and enters the finishing mill 36, spray headers 44 of descalers 30 and 32 propel pressurized stream of water to the strip to remove iron oxide build up. Typically it is desired that the strip temperature lie between 1600° F. and 1850° F. as the strip enters the finishing mill 36; however, the furnace that heats the strip prior to entry into the roughing mill operates at temperatures ranging from 2000° F. to 2300° F. Accordingly, the descalers 30 and 32 also serve to cool the strip prior to entrance into the finishing mill 36. To control the temperature upstream from the F1 stand within the desired range, descaler headers 44 are moved and positioned to create the necessary temperature change shown by the dashed lines in FIGS. 7 and 8. As an alternative to moving these headers, a spray header 42 can be installed ahead of the F1 stand. At a position immediately upstream from the first stand F1 the strip temperature is detected by a temperature detector 34 which transmits a signal representative of the detected strip temperature to a microprocessor 45. As explained in connection with the discussion of FIG. 11, when the detected strip temperature is greater than or equal to 1650° F., microprocessor 45 transmits an "open" command signal to one of the control valves 40 to incrementally open the valve according to the table of FIG. 11 and, thereby, activate its associated interstand cooler. The first four stands F1–F4 are provided with temperature detectors, interstand coolers and control valves all of which are arranged and operate in the manner described above. Accordingly, the system described above serves to intermittently cool the strip while the strip is processed through the individual stands of the finishing mill. As a result, the growth rate of undesirable iron oxide is retarded and the volume of iron oxide build up is reduced.

Also in FIG. 9, there is an alternative embodiment shown in dashed lines. Specifically a valve 41 and a valve control 58 are depicted connected to conduit 33 directly proximate to coolant source 37. In this configuration, the downstream temperature detector 34 located outside of the finishing mill 36 monitors the temperature of the strip as it exists the last stand F7. If the detected temperature is below 1650° F., the microprocessor-based control system signals the valve control 58 (shown in dashed lines) to close the valve 41 (shown in dashed lines) so that the flow of coolant from the coolant source 37 is interrupted until the temperature rises above 1650° F.

Figure 7:
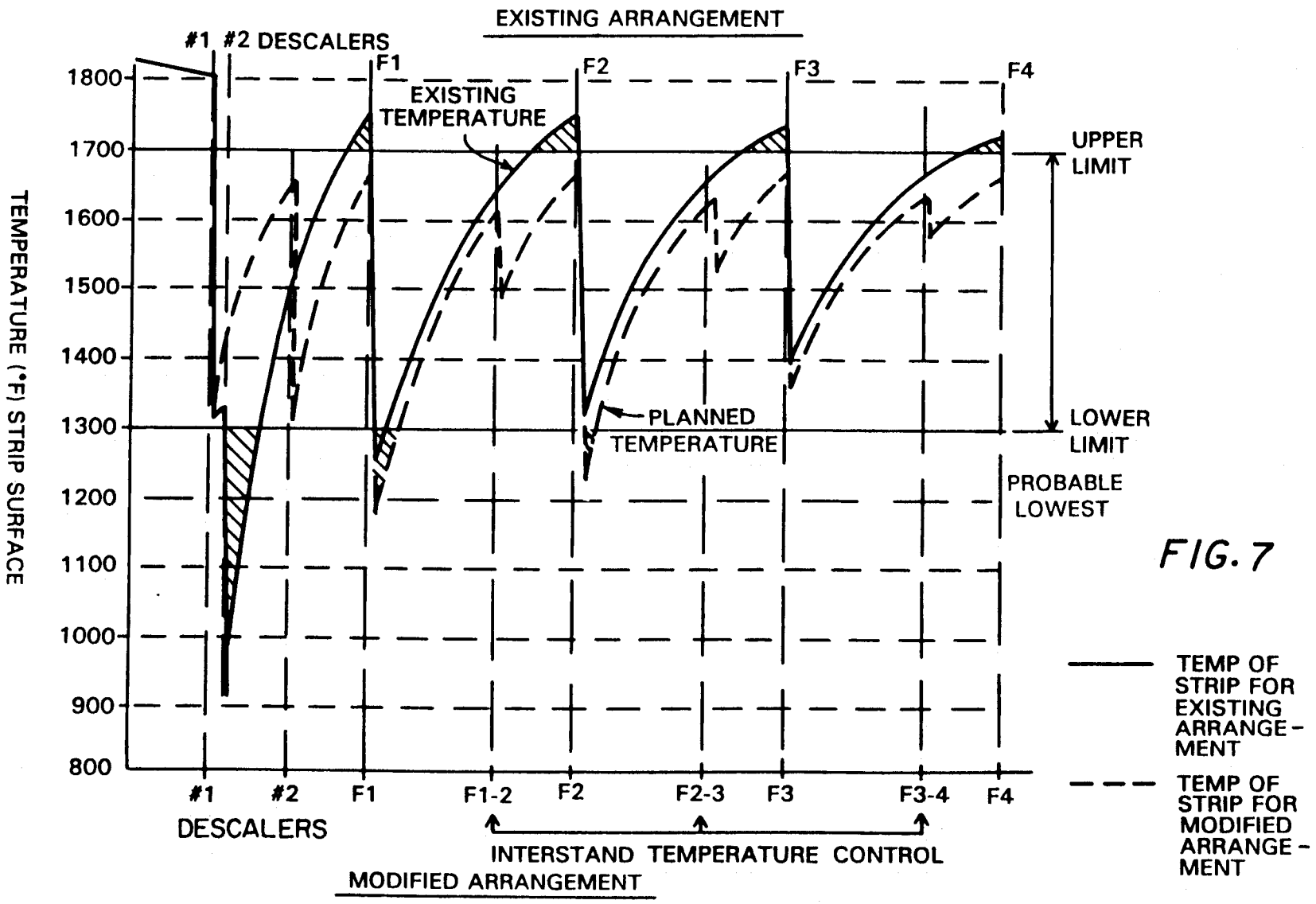
FIG. 7 is a graph illustrating in solid line the surface temperature of an area of a strip as it passes through stands $F_1$ through $F_N$ of the finishing mill of FIG. 1, assuming the mill to be of a first type (a mill without an interstand cooling system), and also illustrating in dashed lines the surface temperature of the same area when the mill is retrofitted with the invention.
Figure 8:
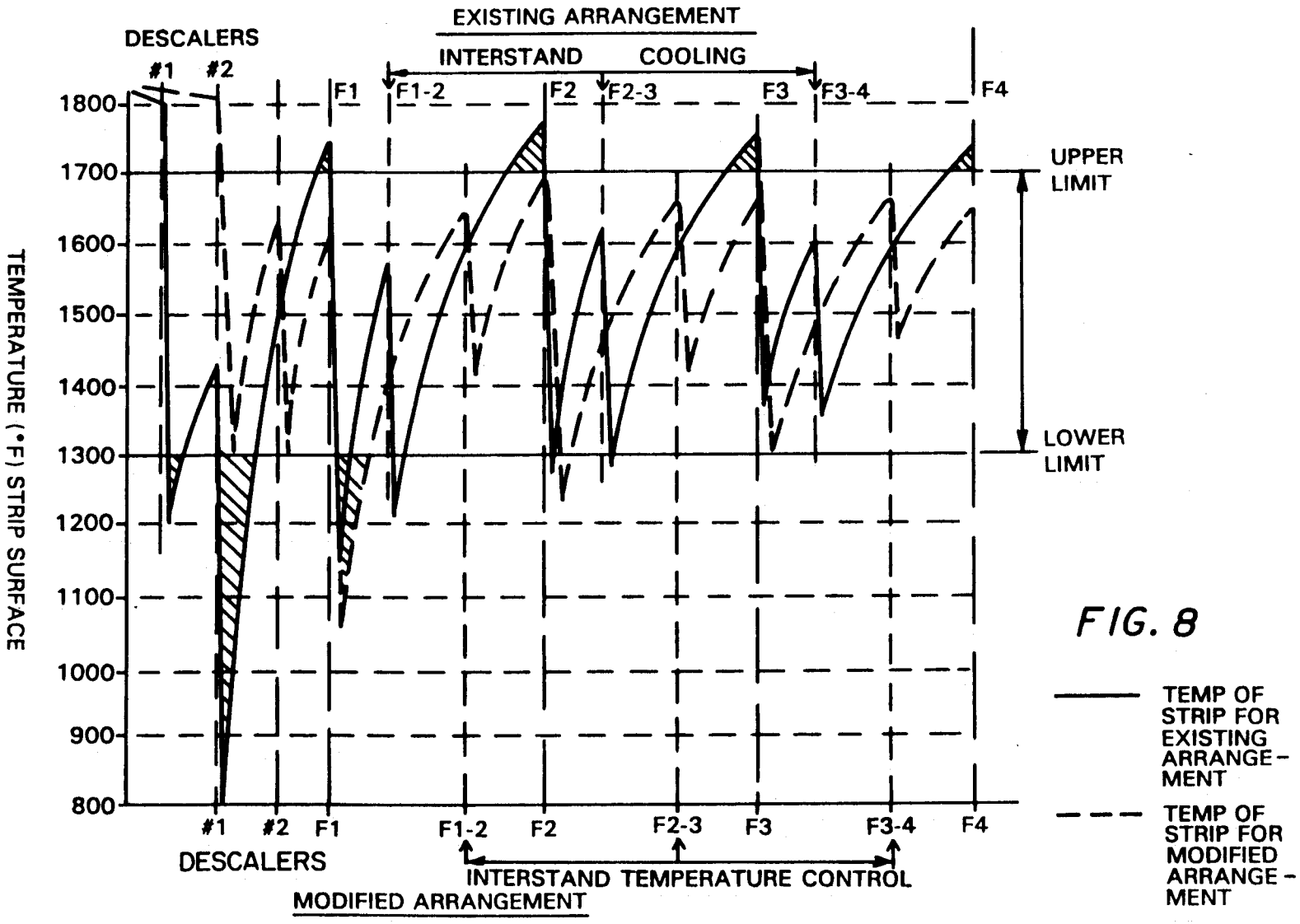
FIG. 8 is a graph illustrating in solid line the surface temperature of an area of a strip as it passes through stands $F_1$ through $F_N$ of the finishing mill of FIG. 1, assuming the mill to be of a second type (a mill equipped with an interstand cooling system), and also illustrating in dashed lines the surface temperature of the same area when the mill is retrofitted with the invention.

The temperature characteristics of the strip at each stand are illustrated in FIGS. 7 and 8. FIG. 7 represents an application of the instant invention in an older hot rolling mill that does not have an interstand cooling system. FIG. 8 represents an application of the instant invention in a modern rolling mill which includes an interstand cooling system. The modern mill of FIG. 8 employs more powerful descalers and its finishing mill can accommodate thicker steel strips. Consequently, the strips move passed the descalers at a slower speed with a greater temperature loss than in the older mills. The temperature characteristics of the strips are herein explained with reference to FIG. 7. The temperature characteristics of FIG. 8 are so similar that no further explanation is necessary. In FIG. 7, the conventional descaler locations are indicated at the top of the graph while the descaler locations according to the invention are depicted at the bottom of the graph. In addition, the solid lines represent the temperatures of the existing mills. The following description will use the dotted lines which indicate temperature patterns of this invention.

Moving now to the operational aspects, the strip temperature is approximately 1800° F. when the strip reaches the first spray header 44 of descaler 30. An appropriate amount of coolant is propelled from spray header 44 to reduce the strip temperature to 1300° F. The strip temperature then rises to 1650° F. as the strip reaches the second spray header 44 of descaler 32 where the strip temperature is again reduced to 1300° F. As the strip enters the first finishing stand F1, the strip temperature rises to just above 1600° F., however, as the strip is deformed during roll contact, the strip temperature drops to just below 1100° F. An interstand temperature controller 42 is positioned between finishing stands F1 and F2 so that when the strip temperature rises just above 1600° F. an appropriate amount of coolant is discharged to chill the strip to 1500° F. and to prevent the strip temperature from rising over 1675° F. before the strip enters the second finishing stand F2. This same procedure is repeated at the third and fourth finishing stands. As illustrated, the magnitude of the strip temperature variation decreases as the strip passes through the finishing mill 36. Consequently, the strip temperature is controlled to vary between 1300° F. And 1650° F. where the amount and rate of abrasive oxide layer growth is smallest.

Figure 10:
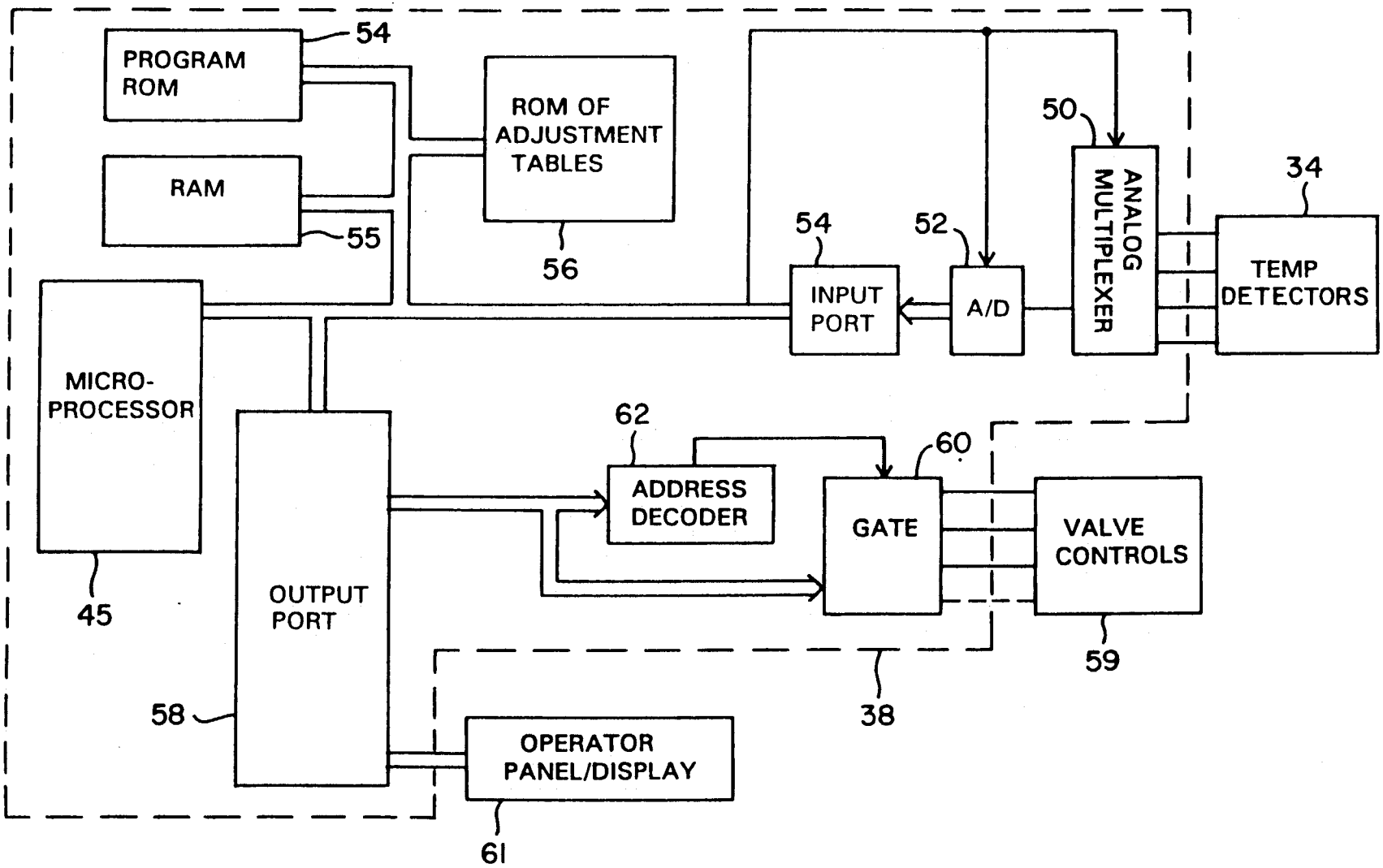
FIG. 10 is a block diagram of an exemplary control system for operating the hardware in FIG. 9 in accordance with the invention.

In keeping with the invention, the operation of interstand temperature controllers 42 are controlled by control system 38, temperature detectors 34 and valve controls 59. FIG. 10 depicts a circuit diagram illustrating the relationship between microprocessor 45, temperature detectors 34 and valve controls 59. A temperature detector 34 detects the surface temperature of the strip and transmits a signal indicative of the detected temperature to analog multiplexer 50 where the signal is processed in the conventional manner. The multiplexed signal is fed to A/D converter 52 where it is converted into a digital signal. Microprocessor 45 receives the digital signal via input port 54. Using the digital signal, microprocessor 45 determines the surface temperature of the strip and transmits an address to ROM 56 corresponding to the determined temperature.

Figure 11:
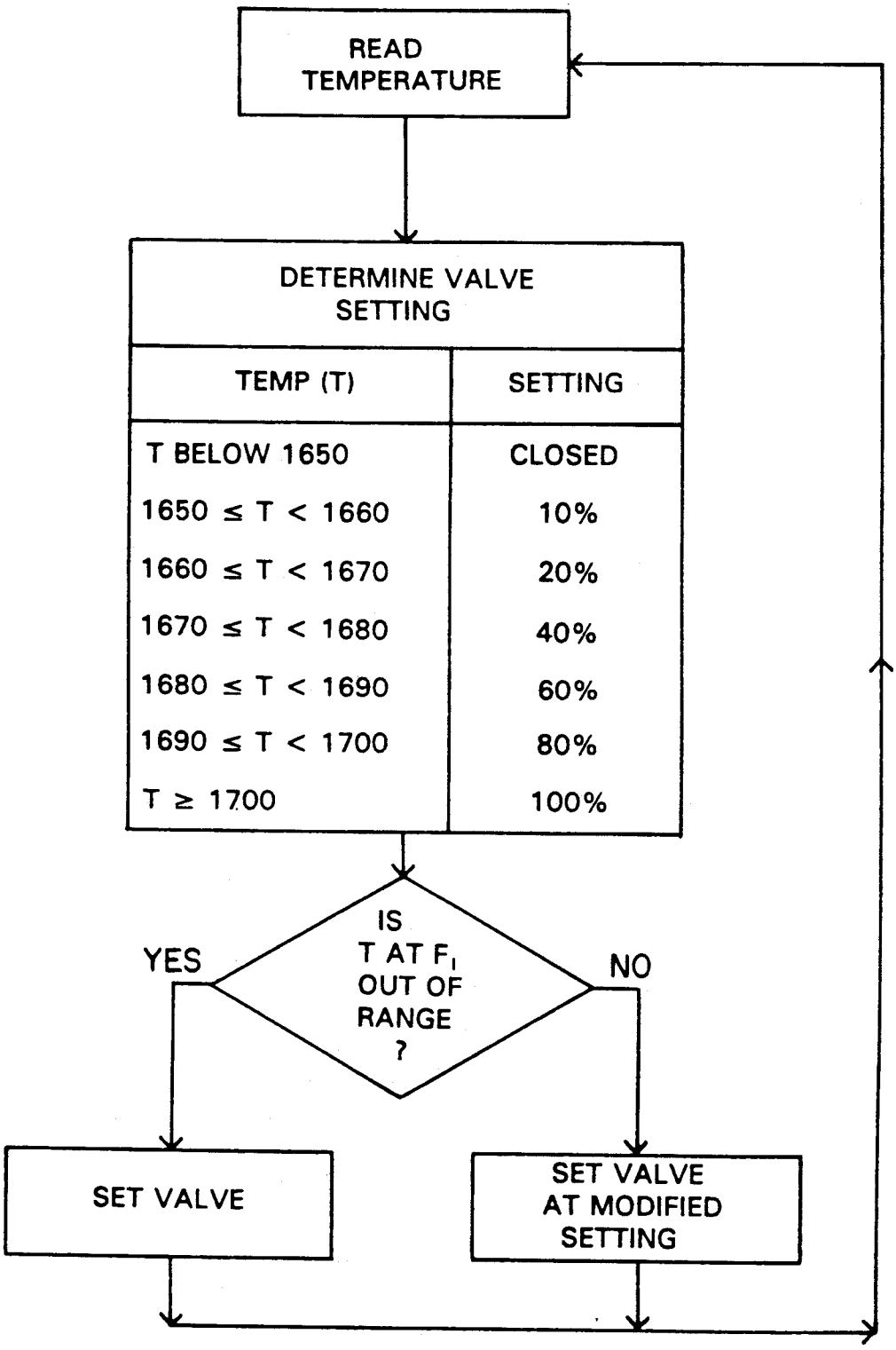
FIG. 11 is a flow diagram for the software of the control system operating the hardware of FIG. 9 for the purpose of maintaining the surface temperatures of the strips within a range of values that minimizes oxide growth resulting in abrasion from slippage between the work rolls and the strip.

In response to the signal from microprocessor 45, ROM 56 outputs an operation command for the control valves 40 which is passed through output port 58, decoded by address decoder 62 and directed through gate 60 to the valve controls 59. The operation command is determined according to the flow chart depicted in FIG. 11. The software for implementing the process depicted in the flow chart of FIG. 11 is stored in program ROM 57. Temporary storage of information is provided the conventional manner by RAM 55. Accordingly, if the strip temperature lies between 1650° F. and 1660° F., ROM 56 transmits a signal to a valve control 59 which opens a corresponding control valve 40 by 10%. If the strip temperature lies between 1660° F. and 1670° F., ROM 56 transmits a signal to a valve control 59 which opens the control valve 40 by 20%. Upon each successive 10° temperature increase, the control valve 40 is opened an additional 20%. When the strip temperature exceeds 1700° F. the control valve 40 is fully opened providing maximum cooling. Also, when the strip temperature is less than 1650° F. the control valve 40 is fully closed and no cooling is provided by interstand temperature controllers 42. However, cooling is provided due to radiation and absorption by the work rolls, but it is not enough to lower the strip temperature below 1300° F. Accordingly, the output of interstand temperature controllers 42 is controlled and the surface temperature of the strips is maintained in a range of 1300° F. to 1650° F. thereby preventing substantial growth of abrasive iron oxide. An operator can monitor the system by inputting commands and viewing the temperature changes on the operator panel/display 61.

In accordance with another aspect of the invention, the cooling capacity of the interstand coolers can be further adjusted by any one or a combination of the following: 1) varying the incident angle of the interstand temperature controllers 42, 2) changing the mill speed, 3) increasing the number of interstand coolers, and 4) changing the pressure of coolant propulsion. These methods can be used in combination with the control valve method described above to achieve more precise control of strip temperature.

In another embodiment, one temperature detector 34 can be connected to microprocessor 45 and placed either immediately upstream or immediately downstream from the first stand F1. No other temperature detectors are employed. By way of operation, on the basis of the detected temperature and the known temperature drops at each finishing mill roll, microprocessor 45 predicts the strip temperature at each successive finishing mill roll and transmits an "open" command to the respective control valves 40 according to the procedure described above and set forth in the flow chart of FIG. 11.

In yet another embodiment of the invention, each control valve and each temperature detector is connected to a separate microprocessor which controls the output of its corresponding interstand cooler. A master microprocessor is connected to a temperature detector located at a position immediately downstream from finishing mill F7 for providing override control of the system based on the exit strip temperature. That is, the microprocessor transmits an "open" signal to the control valves if the exit strip temperature is too high, and a "close" signal if the exit strip temperature is too low.

Although the illustrated embodiments have been described herein, it is to be understood that numerous variations and modifications of these embodiments within the scope of the appended claims will become apparent to the skilled artisan.

I claim:

1. In a hot strip rolling mill, a method of reducing the growth of $Fe_3O_4$ on metal strips comprising the steps of:

passing the strips through successive pairs of cooperating work rolls; and spraying the strip between the pairs of work rolls with a sufficient amount of coolant to substantially maintain the surface temperature of the strip within a range of 1300° F. to 1675° F. to thereby reduce growth of $Fe_3O_4$ on the strip.

2. In a hot strip rolling mill comprising a finishing mill having a plurality of stands $F_1$ through $R_H$, where each stand includes a pair of opposing work rolls, a method of reducing oxide growth on metal strips comprising the steps of:

descaling each of the strips before entering the finishing mill such that the surface temperature of the strip is maintained below 1700° F.;

determining the temperature of the strip at a downstream point immediately following the exit of the strip from the finishing mill;

determining the strip temperature at predetermined points located between selected adjacent stands;

spraying the strip with coolant at each predetermined point to substantially maintain the surface temperature of the strip between 1700° F. and 1300° F. in order to minimize growth of the oxide $Fe_3O_4$.

3. In a hot strip rolling mill comprising a finishing mill having a plurality of stands $F_1$ through $F_N$, where each stand includes a pair of opposing work rolls, a method of reducing oxide growth on metal strips comprising the steps of:

placing descaling headers upstream from the finishing mill and relative to one another and to a first stand $F_1$ such that the surface temperature of the strip remains substantially between an upper limit 1700° F. and a lower limit 1300° F. between the first stand $F_1$ and the descaling header that is farthest upstream;

positioning interstand coolers between selected adjacent stands;

determining the surface temperature of the strip at the interstand coolers;

spraying the strip with coolant at each of the interstand coolers; and controlling the spraying of coolant in order to maintain the surface temperature of the strip at substantially all times below the upper limit 1700° as the strip is worked by the plurality of stands $F_1$–$F_N$ of the finishing mill.

4. The method of claim 3 wherein the step of controlling the spraying of the coolant includes:

incrementally opening and closing a control valve at each interstand cooler in response to the surface temperature of the strip measured at each cooler.

5. The method of claim 4 further including the steps of:

measuring the temperature of the strip at a downstream point immediately following exit of the strip from the finishing mill; and closing selected ones of the control valves when the temperature measured at the downstream point is below a predetermined minimum finishing temperature.

* * * * *